United States Patent [19]

Dodge

[11] Patent Number: 4,736,205

[45] Date of Patent: Apr. 5, 1988

[54] BUOY LANTERN ASSEMBLY EMPLOYING HINGED GIMBAL

[75] Inventor: Robert J. Dodge, Houston, Tex.

[73] Assignee: Automatic Power, Inc., Houston, Tex.

[21] Appl. No.: 873,033

[22] Filed: Jun. 11, 1986

[51] Int. Cl.[4] ..... G08G 3/00

[52] U.S. Cl. ..... 340/985; 116/26; 116/107; 340/984; 441/13; 441/16

[58] Field of Search ..... 340/984, 985, 74, 84, 340/87, 90, 114 R, 138, 142, 143; 116/107, 26, 35 A; 441/11, 13, 16, 21; 248/176, 182, 183

[56] References Cited

U.S. PATENT DOCUMENTS

| | | | |
|---|---|---|---|
| 1,303,860 | 5/1919 | Dalen | 441/13 |
| 1,689,624 | 10/1928 | Eskilson et al. | 441/13 |
| 2,900,823 | 8/1959 | White | 248/183 |
| 3,765,631 | 10/1973 | Herbst et al. | 248/183 |
| 3,818,428 | 6/1974 | Phipps et al. | 340/984 |
| 4,189,122 | 2/1980 | Miller | 73/178 R |
| 4,224,707 | 9/1980 | Mariani | 441/11 |
| 4,258,578 | 3/1981 | Kennel | 248/183 |
| 4,452,654 | 6/1984 | KaDell, Jr. | 248/182 |
| 4,464,129 | 8/1984 | Vancheri et al. | 116/26 |
| 4,626,852 | 12/1986 | Dodge | 441/16 |

FOREIGN PATENT DOCUMENTS

| | | | |
|---|---|---|---|
| 0115378 | 9/1969 | Denmark | 441/11 |
| 0036161 | 3/1980 | Japan | 441/13 |
| 0152692 | 11/1980 | Japan | 441/16 |

*Primary Examiner*—Donnie L. Crosland
*Assistant Examiner*—Brent A. Swarthout

[57] ABSTRACT

Marine buoy lantern employs a heavily damped two-axis gimbal including an outer gimbal frame supported to the lantern housing by a pair of hinges and an inner gimbal member mounted to the outer gimbal frame by another pair of hinges. The hinges are made of plastic and respond very slowly to a torque applied thereto unlike gimbals employing bearings. The inner gimbal member supports the drum lens, flasher, lampchanger, and counterweights. The hinged gimbal cooperates with the counterweights immersed in a very viscous fluid to maintain the lantern vertically disposed notwithstanding angles of inclination of ±9°, or a total of 18°, of the marine buoy mounting the lantern atop thereof.

3 Claims, 3 Drawing Sheets

BUOY LANTERN ASSEMBLY EMPLOYING HINGED GIMBAL

STATEMENT OF THE INVENTION

The present invention relates to buoy marine lanterns and more particularly to an improved gimbal structure used therein which responds very slowly while compensating for the list or heel of the buoy supporting the lantern.

CROSS-REFERENCE TO OTHER APPLICATIONS

Reference is made to copending application of Robert J. Dodge for "Buoy Lantern System", Ser. No. 576,062, filed Feb. 1, 1984 now U.S. Pat. No. 4,626,852, granted June 2, 1987, and assigned to the assignee hereof.

BACKGROUND AND SUMMARY OF THE INVENTION

Buoy marine lanterns serve, for example, as navigational aids to provide rugged markers for underwater obstructions and navigational channels. When properly moored, the buoys with lantern will withstand hurricane force winds and seas.

The present lantern employs a gimbal whose main purpose is to compensate for the list of the buoy caused by wind and current. An objection to the use of gimbals for marine lanterns is the resultant violent motion thereof when the period of the buoy oscillation coincides with the natural frequency of the gimbal mechanism. Very often, the gimbal is destroyed as well as damage being suffered by the lampchanger and flasher.

The present gimbal eliminates any possibility of violent motion thereof. It is appreciated that the effects of the list of the buoy caused by the wind and current occur rather slowly. The present gimbal is caused to respond slowly to these effects by means of a very viscous fluid in the lantern body which immerses the counterweights suspended from the gimbal, and the use of plastic hinges for the gimbal in lieu of conventional bearing members.

The heavy dampening provided by the viscous fluid and plastic hinges result in a gimbal having a very long natural period of vibration, thus minimizing the harmful effects caused by the wind and current. Rapid response is not needed because the present lantern compensates principally for the list of the buoy, and not for rapid wave motion of small waves. The gimbal will respond however, to a degree, to all motions, so performance will be improved even for wave motion.

The present gimbal includes an outer frame, preferably square or rectangular in cross-section, and an inner member mounted thereto by means of a pair of hinges articulating therebetween, and another pair of hinges articulating between the outer frame and housing of the lantern, each pair of hinges being disposed along different axes.

The inner gimbal member or frame suspends the counterweights therebelow which are immersed in a dampening liquid medium having a viscosity of approximately 100,000 SSU. Supported on the inner gimbal member are the drum lens, lampchanger and flasher.

Due principally to the present gimbal structure, the buoy lantern remains in a substantially vertical position for angles of inclination of the buoy about $\pm 9°$, or a total of 18 degrees. As a result, the effectiveness of the buoy light is improved. That is, a lamp of considerably lesser wattage may be used in the present lantern to obtain an equivalent range of a lantern without the improved gimbal at appreciable angles of list of the buoy.

DETAILED DESCRIPTION OF THE INVENTION

Figure 1:
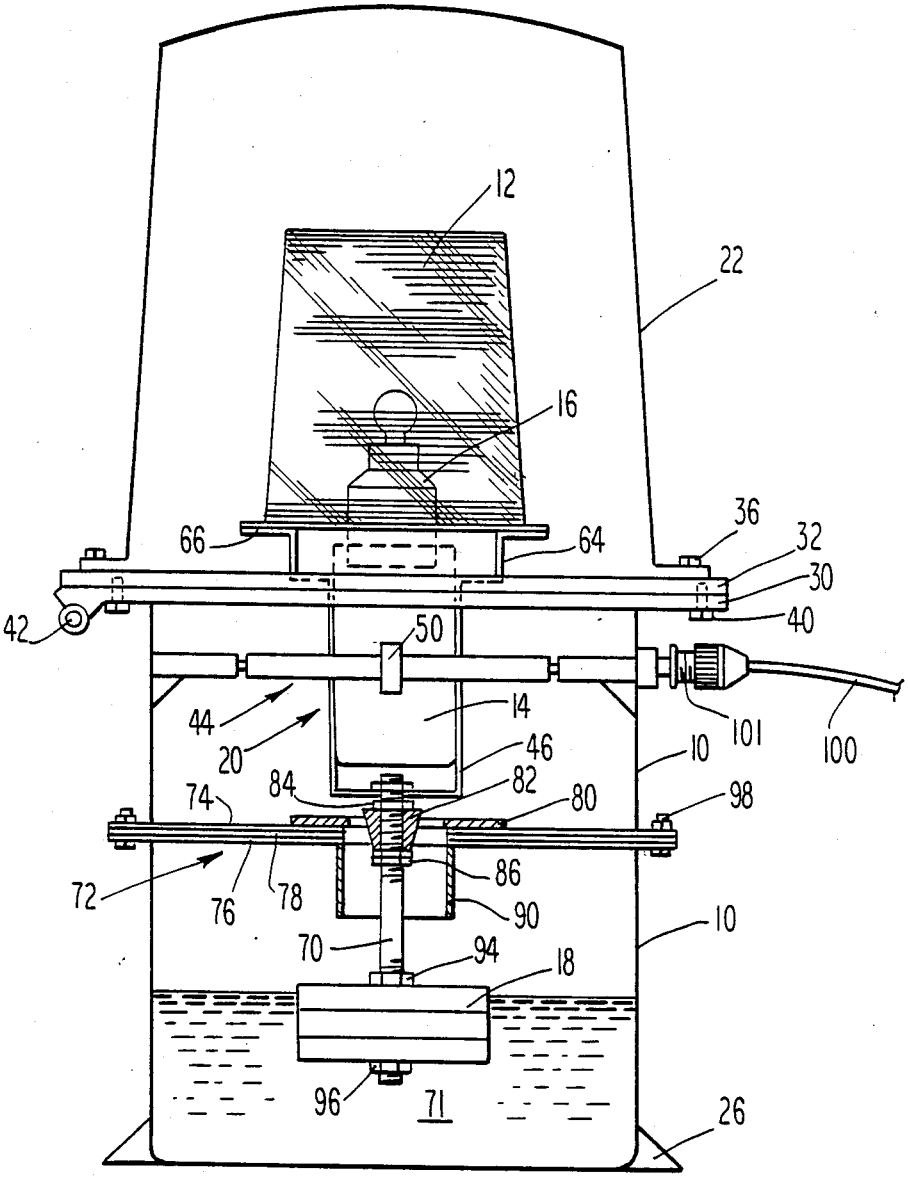
FIG. 1 is an elevational diagrammatic view, part in section and part in phantom, of the lantern of the present invention
Figure 2:
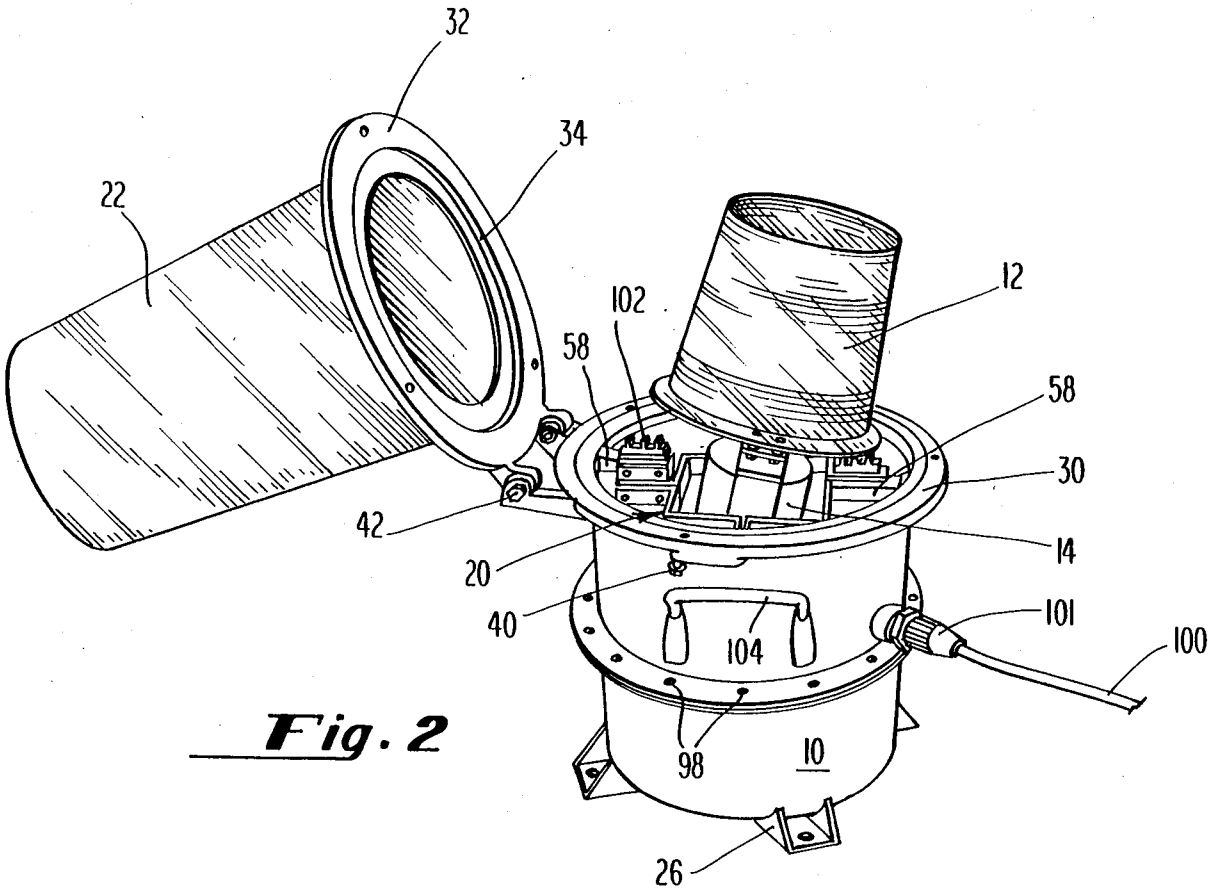
FIG. 2 is a perspective view illustrating the present lantern with components thereof exposed to the atmosphere.

In FIGS. 1 and 2, the buoy lantern device of the present invention includes a housing 10, fresnel-type drum lens 12, flasher 14, lampchanger 16, and counterweights 18, all but housing 10 supported on a gimbal structure 20. The device additionally comprises a clear lens cover 22 surrounding drum lens 12, both conveniently made of acrylic, or other suitable clear plastic.

Flasher or timer 14 is conventional, may be purchased off-the-shelf, and is preferably solid state capable of complex flash up to five or more characters per period, including any Morse code letter or any number code. Specific flash characteristics desired by a customer may readily be designed into the flasher.

A daylight control or sun switch (not shown) is used with flasher 14 and is mounted atop thereof. The sun switch is a photocell control which permits the lantern to flash only when the intensity of the ambient light falls below a certain level.

Lampchanger 16 is a standard component of current battery-operated lanterns and may have four or six single contact, pre-focused lamps, operating on a dc voltage from battery or batteries (not shown), preferably 12 volt. Lammpchanger 16 is conventional and typically includes a two-relay system, i.e., the coil of the series relay is wired in series with the lamps in service. The motor armature holds the motor relays open as long as the current grounds through the lamp filament. When the lamp filament burns out, the motor relay circuit closes to cause the lamp turret to rotate until a new lamp is in operating position.

The batteries are preferably rechargeable sealed type employing a gelled electrolyte with calcium grids and low self-discharge rate.

Housing 10 is provided at the lantern base portion with a plurality of bolt-down means 26 for securing the lantern to an upper surface of the buoy (not shown). Housing 10 is provided at its uppermost portion with a rim 30 which mates with an upper rim 32 supporting lens cover 22. Rims 30 and 32, preferably aluminum (as is housing 10), are maintained in watertight relationship by means of an O-ring (not shown) disposed in recess 34 of the lower face of upper rim 32. Lens cover 22 may be secured to the upper surface of upper rim 32 by screws 36 (FIG. 1) or otherwise suitably attached thereto. To insure further water tightness between the lens cover 22 and upper ring 32, another O-ring (not shown) may be disposed in a suitable recess (not shown) in the upper surface of upper rim 32.

Access to the interior of the lantern is effected by simply removing retaining screws 40 and pivoting the upper rim 32 on hinge 42 articulating between the rims, as shown in FIG. 2.

Gimbal 20 comprises an outer frame 44 disposed in a substantially horizontal plane and an inner frame 46 disposed in a substantially vertical plane.

Figure 3:
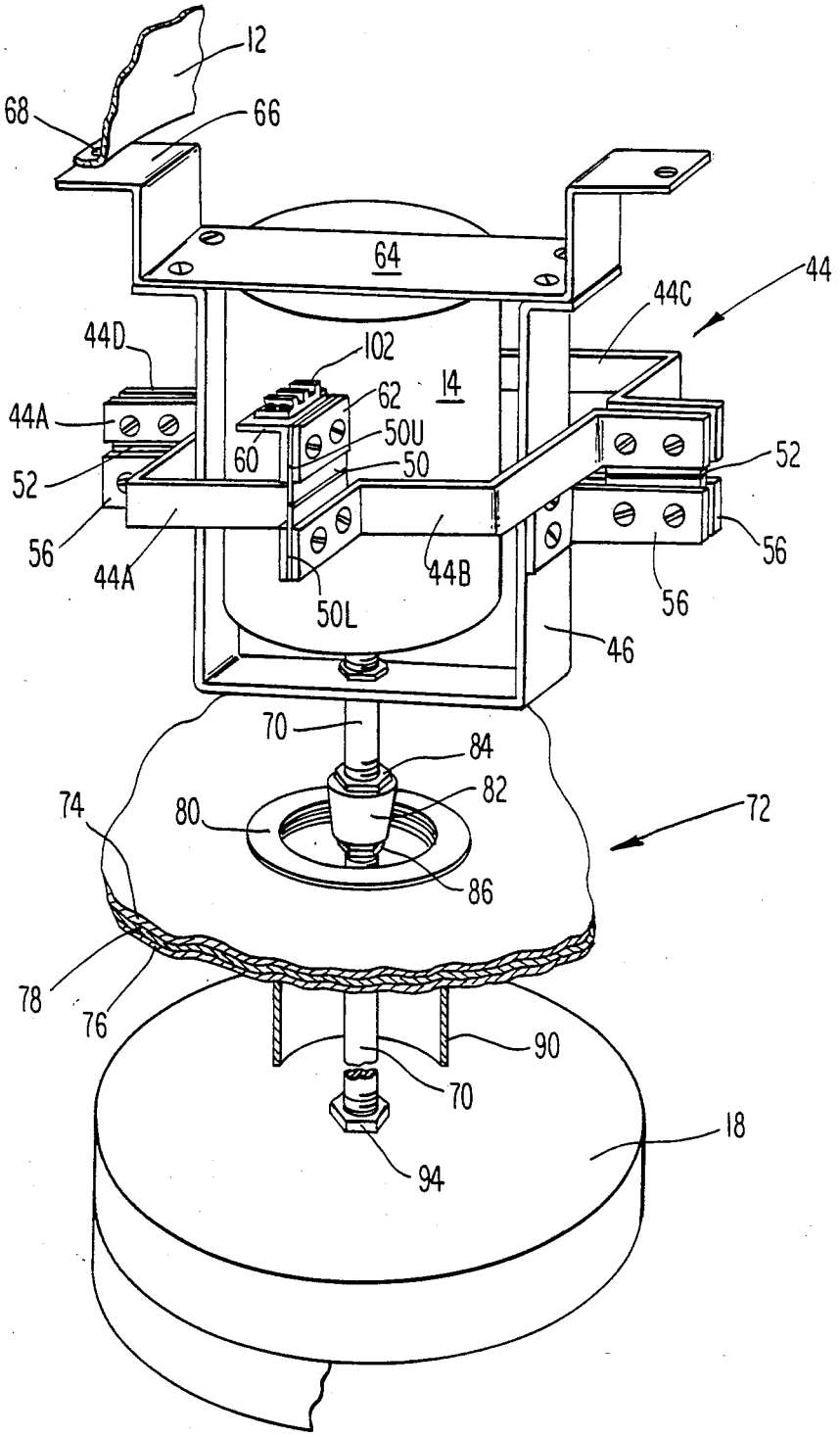
FIG. 3 is a perspective view of the improved gimbal arrangement of the lantern of FIG. 1 with associated components shown fragmentally, part in section and parts broken away.

The outer frame 44 comprises four angled components, i.e., 44A, 44B, 44C and 44D (FIG. 3), serially connected by hinges to form a closed member. That is, a hinge 50 has its lower portion 50L connected between components 44A and 44B by screw means and another hinge 50 (not shown) is similarly connected between components 44C and 44D.

Upper portion of hinge 52 is mounted between components 44B and 44C to provide articulation between the outer frame and inner frame 46 by means of a pair of angled brackets 56 extending outwardly therefrom for mounting therebetween a lower portion of the hinge. A similar hinge member 52 has its upper portion mounted between components 44A and 44D for articulation with the inner frame by means of a lower portion of the hinge being mounted between another pair of brackets 56 similarly extending from the inner frame.

Gimbal 20 is supported by housing 10 at an upper interior portion thereof by means of a pair of rigid arms 58 (FIG. 2) extending therefrom substantially along a diameter thereof. Arms 58 are conveniently welded to the housing. Support of the gimbal to the housing is effected through an angled bracket 60 suitably secured to each arm 58 and a plate member 62 screw mounted to angled bracket 60 after capturing an upper portion 50U of each hinge 50 therebetween.

An angled support member 64 is screw mounted to an upper portion of inner frame 46. Support member 64 is provided with bracket portions 66 which carry drum lens 12 thereon by means of screws 68. Lampchanger 16 is suitably mounted on angled support member 64.

Referring again to FIG. 3, counterweights 18 are suspended from a lowermost section of inner frame 46 by means of a partially threaded counterweight rod 70, typically ⅜" in diameter. Counterweights 18 are suspended in a highly viscous fluid 71, preferably a silicone oil having a viscosity of 100,000 Saybolt universal seconds. The viscosity of silicone oil or fluid is known to be generally stable to temperature changes. Five pints of fluid 71 are normally required to cover the 3 counterweight plates 18 used in the present lantern apparatus.

Housing 10 is provided with a flanged assembly 72 (FIGS. 1, 2 and 3) approximately midway thereof. Assembly 72 comprises an upper plate 74, lower plate 76, and gasket 78 (preferably silicone), sandwiched therebetween. Plates 74 and 76 are suitably aluminum. Upper plate 74 threadedly receives a bumper plate 80, which coacts with a conically shaped bumper 82 (FIGS. 1 and 3) threaded onto rod 70. The bumper assembly, i.e., bumper 82 and bumper plate 80, both conveniently nylon, assist in controlling the extent of lateral movement of bumper 82 within the limits of bumper plate 80, and, therefore, also limits the movement of inner frame 46 connected thereto.

The outer diameter of bumper plate 80 may be about 4½" and the inner diameter about 2" less. The bumper 82 measures about 1⅛" high, has a diameter of about 1½" at its upper portion which tapers uniformly at 10° to an 0.85" diameter at its narrowest portion.

Threading bumper 82 upwardly on rod 70 permits less restricted movement of the gimbaled components. Locking nuts 84 and 86 should be securely tightened after bumper 82 is positioned. Of course, lock washers (not shown) may be inserted between the bumper and locking nuts. It should be noted that bumper 82 should not be threaded so far upwardly that lens 12 is permitted to contact lens cover 22.

An axially disposed open-ended cylinder 90 is welded to lower plate 76 of flanged assembly 72. Cylinder 90 is a baffle which resists leakage of fluid 71 even if the marine buoy supporting the present lantern is tipped more than 90° from vertical which occasionally happens during servicing.

Balancing of gimbal 20 may be effected by moving counterweights 18 laterally on rod 70. Counterweight holes (not shown) are thus made slightly larger in diameter than the diameter of rod 70 to permit some lateral movement of the counterweights. Counterweight locking nuts 94 and 96 must be tightened after properly positioning counterweights 18. Screws 98 (FIGS. 1 and 2) may be tightened after counterweights 18 are locked into position and fluid 71 poured thereover.

The 12 volt dc battery power for supplying energy to the lantern is applied through power cable 100 and a cable packing gland 101.

Electrical terminal blocks 102 are conveniently located on angled brackets 60. Wires should not interfere with moving gimbal parts. Wiring and electrical connections are conventional and are not shown or described herein, and form no part of the present invention.

A pair of carrying handles 104 completes the lantern device.

Hinges 50 and 52 are preferably made of polypropylene or polyallomer which are tough and highly fatigue-resistant. The hinges may suitably be cabinet type, butt type, and the like, formed by injection molding, hot-stamping, machining or extrusion. Because of the flexing that the hinges must withstand, elimination of notches and sharp corners is desirable.

The use of hinges as abovedescribed in lieu of bearings in marine gimbal structures offers many advantages:

(a) they will not corrode or rust in a marine environment, (b) they are approximately 20 times less expensive than bearings, (c) they are expected to continue functioning indefinitely, i.e., flexed several million times without failing, (d) they add considerably to the dampening effect of the gimbal as well as increasing the natural period of vibration thereof thus reducing the amplitude of response of the gimbal to the motion of the buoy produced by the sea.

The present lantern, when mounted atop a marine buoy, remains in a substantially vertical position for angles of inclination of the buoy of ±9°, or a total of 18, due to the presence in the lantern of the improved gimbal arrangement. The resulting effectiveness of the present buoy lantern compares favorably with typical commercial available buoy lanterns employing lamps therein up to 10 times the wattage.

For example, the present lantern with 20° divergence and employing a 6 watt lamp therein produced light signals at a distance of 7.2 nautical miles therefrom at 4.5° angles of list, which signals were equivalent to those generated by commercially available buoy lanterns employing 60 watt lamps therein under identical conditions. Furthermore, the luminous intensity of the present lantern remained constant for angles of list approaching ±9°.

In a further example, a typical commercial wide divergence buoy lantern employing a 10 watt lamp therein produced 100 candela of luinous intensity at ±2° tilt. Under the same conditions, the present lantern produced the same luminous intensity with a 6.6 watt lamp. But, even at vertical divergences approaching 20°, the luminous intensity of the present lantern remained at 100 candela.

I claim:

1. In lantern apparatus supported atop a marine buoy and having a housing at a lower portion thereof, a lens, lamp means, flasher, and lens cover protecting said lens, means for supplying electrical power to said lamp means, the improvement to said lantern apparatus comprising a two-axis gimbal mounted within said lantern housing, said gimbal having an outer frame and an inner frame, first hinge means for supporting said outer frame said housing and permitting relative movement therebetween, second hinge means for supporting said inner frame to said outer frame while permitting movement of each frame substantially along an axis disposed substantially normally to the other, said inner frame carrying said lens, lamp means and flasher, and counterweight means suspended therebelow, said counterweight means being immersed in a viscous dampening fluid contained within said housing at a lower portion thereto, to dampen movement of said counterweight means about said first and second hinge means of said gimbal and thereby provide vertical stability to said lantern during listing of said buoy.

2. Apparatus of claim 1 wherein said fluid is a silicone oil having a viscosity of about 100,000 Saybolt universal seconds.

3. Apparatus of claim 1 wherein said counterweight means are suspended from said inner frame by a threaded rod movable therewith, bumper means adjustably secured to said rod intermediate said counterweight means and said inner frame, limiting means surrounding said bumper means in a substantially horizontal plane for controlling extent of horizontal movement of said bumper means and said inner frame, and flange means secured to said housing for supporting said limiting means.

* * * * *